US005507060A

United States Patent [19]

Quimpo

[11] Patent Number: 5,507,060

[45] Date of Patent: Apr. 16, 1996

[54] APPARATUS FOR AUTOMATICALLY CLEANING BABY BOTTLES INSIDE AND OUT

[76] Inventor: Lester A. Quimpo, 1842 Hunt Ave., Bronx, N.Y. 10462

[21] Appl. No.: 344,024

[22] Filed: Nov. 23, 1994

[51] Int. Cl.[6] ..... B08B 3/02; B08B 9/08

[52] U.S. Cl. ..... 15/63; 134/99.2; 134/138; 134/141; 134/144; 134/152; 134/153; 134/158; 134/170; 134/171

[58] Field of Search ..... 15/63; 134/99.2, 134/138, 141, 144, 152, 153, 158, 170, 171

[56] References Cited

U.S. PATENT DOCUMENTS

| | | | |
|---|---|---|---|
| 870,730 | 11/1907 | Laible | 15/63 |
| 2,393,394 | 1/1946 | Meyer | 134/171 |
| 3,731,696 | 5/1973 | Hackney | 134/170 X |
| 4,422,466 | 12/1983 | Schafer | 134/170 X |

FOREIGN PATENT DOCUMENTS

| | | | |
|---|---|---|---|
| 624398 | 6/1949 | United Kingdom | 134/170 |

*Primary Examiner*—Philip R. Coe

[57] ABSTRACT

An apparatus for automatically cleaning baby bottles inside and out comprising a base in a generally rectangular configuration having a floor, a drain thereabove and offset from parallel therewith for water run off and parallel side walls therebetween; a centrally-located cylindrical manifold extending upwardly through the drain to a location thereabove; a plurality of baby bottle holders rotatably mounted for rotation above the drain, the bottle holders being annular in configuration with an upstanding cylindrical side wall and internal threads for receiving the upper extent of inverted baby bottles to be washed, the holders having apertures in the lower extents of their walls for the draining of water therefrom; a peripheral tube extending upwardly for rotation and with apertures therein for spraying the insides of bottles; and a drive gear beneath the drain, the drive gear including a central gear for acting through a motion imparting assembly for rotating the manifold and a plurality of upper peripheral gears for rotating the bottle holders, a plurality of lower peripheral gears for rotating the peripheral tubes and with a drive to concurrently rotate the manifold, peripheral tubes and holders, the drive means including a paddle wheel with gear teeth to drive the drive gear. Brushes with bristles cover the peripheral tubes and manifold which scrub the inside and outside surfaces of the bottles.

6 Claims, 5 Drawing Sheets

FIG 3
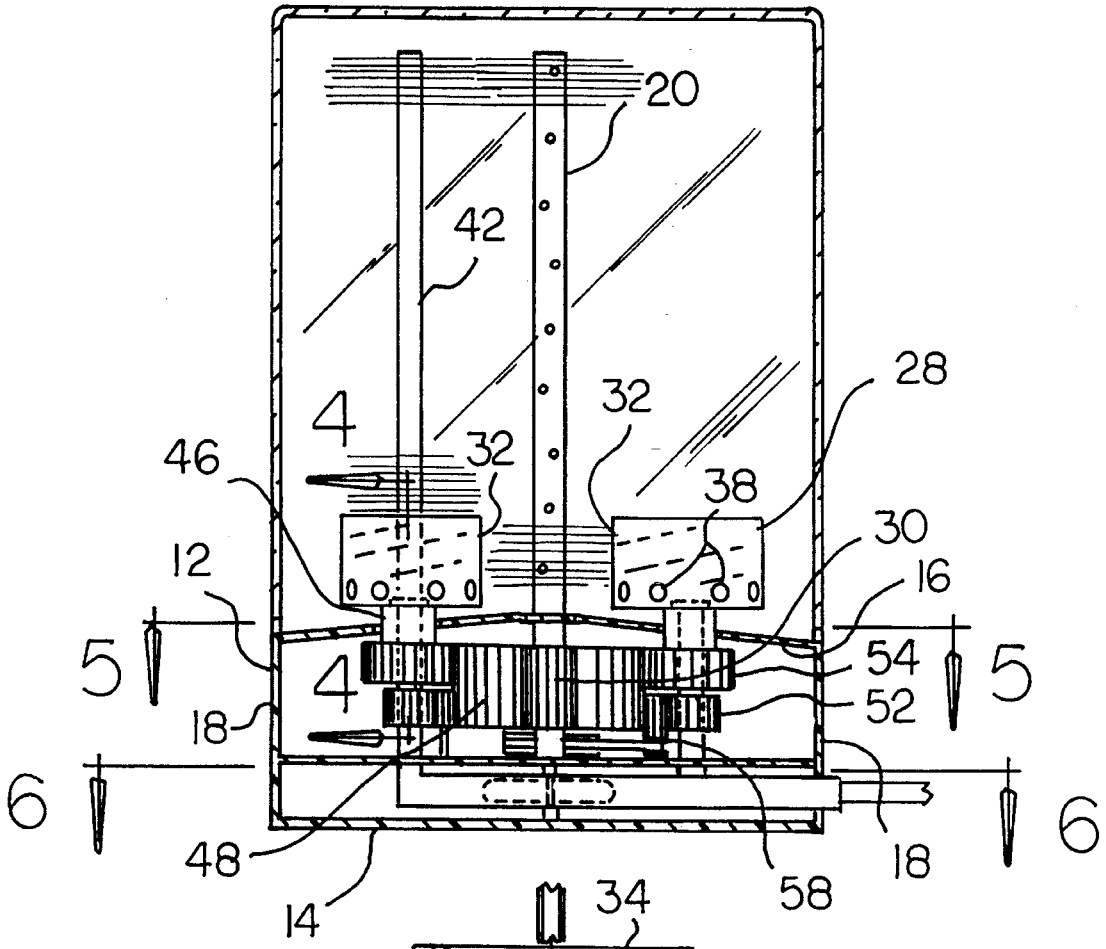
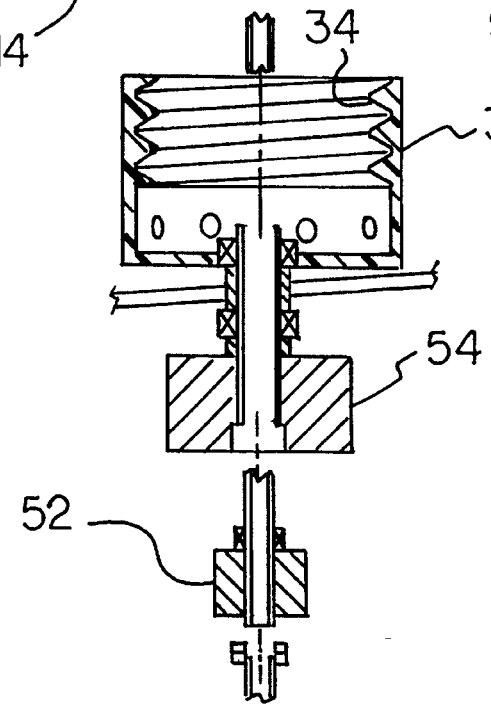
FIG 4

APPARATUS FOR AUTOMATICALLY CLEANING BABY BOTTLES INSIDE AND OUT

BACKGROUND OF THE INVENTION

1. Field of the Invention

The present invention relates to an apparatus for automatically cleaning baby bottles inside and out and more particularly pertains to cleaning a plurality of baby bottles simultaneously with maximum convenience and efficiency.

2. Description of the Prior Art

The use of kitchen devices for cleaning a wide variety of objects and devices is known in the prior art. More specifically, devices for cleaning a wide variety of objects and devices heretofore devised and utilized for the purpose of cleaning items in the kitchen through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,956,791 a bottle washing machine.

U.S. Pat. No. 4,010,774 discloses a rotary spray station for bottle washers.

U.S. Pat. No. 4,667,690 discloses a bottle washing apparatus.

U.S. Pat. No. 5,009,241 discloses an apparatus for washing narrow neck bottles.

U.S. Pat. No. 5,235,996 discloses a bottle washer with multiple carrier.

In this respect, the apparatus for automatically cleaning baby bottles inside and out according to the present invention substantially departs from the conventional concepts and designs of the prior art, and in doing so provides an apparatus primarily developed for the purpose of cleaning a plurality of baby bottles simultaneously with maximum convenience and efficiency.

Therefore, it can be appreciated that there exists a continuing need for a new and improved apparatus for automatically cleaning baby bottles inside and out which can be used for cleaning a plurality of baby bottles simultaneously with maximum convenience and efficiency. In this regard, the present invention substantially fulfills this need.

SUMMARY OF THE INVENTION

In view of the foregoing disadvantages inherent in the known types of kitchen devices for cleaning a wide variety of objects and devices now present in the prior art, the present invention provides an improved apparatus for automatically cleaning baby bottles inside and out. As such, the general purpose of the present invention, which will be described subsequently in greater detail, is to provide a new and improved apparatus for automatically cleaning baby bottles inside and out and method which has all the advantages of the prior art and none of the disadvantages.

To attain this, the present invention essentially comprises a new and improved apparatus for automatically cleaning baby bottles inside and out comprising, in combination, a base in a generally rectangular configuration having a floor, a drain thereabove and offset from parallel therewith for water run off and parallel side walls therebetween; a centrally-located cylindrical manifold extending upwardly through the drain to a location thereabove; a plurality of baby bottle holders rotatably mounted for rotation above the drain, the bottle holders being annular in configuration with an upstanding cylindrical side wall and internal threads for receiving the upper extent of inverted baby bottles to be washed, the holders having apertures in the lower extents of their walls for the draining of water therefrom; a peripheral tube extending upwardly for rotation and with apertures therein for spraying the insides of bottles; a drive gear beneath the drain, the drive gear including a central gear for acting through a motion imparting assembly for rotating the manifold and a plurality of upper peripheral gears for rotating the bottle holders, a plurality of lower peripheral gears for rotating the peripheral tubes and with a drive to concurrently rotate the manifold, peripheral tubes and holders, the drive means including a paddle wheel with gear teeth to drive the drive gear; a tube having an input end adapted to be coupled to a source of water under pressure, the tube having a plurality of apertures therein coupled to the lower extent of each peripheral tube and manifold for the spraying of water to interior of the bottles and exterior thereof simultaneously, the tube also including a region coupled with the paddle wheel for powering the paddle wheel for rotation of the drive gear; and a transparent cover having a plurality of side walls in a rectangular configuration with a transparent top wall and an opening at the lower extent, the opening at the lower extent adapted to fit over the base in a watertight relationship.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for automatically cleaning baby bottles inside and out which has all the advantages of the prior art kitchen devices for cleaning a wide variety of objects and devices and none of the disadvantages.

It is another object of the present invention to provide a new and improved apparatus for automatically cleaning baby bottles inside and out which may be easily and efficiently manufactured and marketed.

It is a further object of the present invention to provide a new and improved apparatus for automatically cleaning baby bottles inside and out which is of durable and reliable constructions.

An even further object of the present invention is to provide a new and improved apparatus for automatically cleaning baby bottles inside and out which is susceptible of a low cost of manufacture with regard to both materials and labor, and which accordingly is then susceptible of low prices of sale to the consuming public, thereby making such apparatus for automatically cleaning baby bottles inside and out economically available to the buying public.

Still yet another object of the present invention is to provide a new and improved apparatus for automatically cleaning baby bottles inside and out which provides in the apparatuses and methods of the prior art some of the advantages thereof, while simultaneously overcoming some of the disadvantages normally associated therewith.

Still another object of the present invention is to clean a plurality of baby bottles simultaneously with maximum convenience and efficiency.

Lastly, it is an object of the present invention to provide a new and improved apparatus for automatically cleaning baby bottles inside and out comprising a base in a generally rectangular configuration having a floor, a drain thereabove and offset from parallel therewith for water run off and parallel side walls therebetween; a centrally-located cylindrical manifold extending upwardly through the drain to a location thereabove; a plurality of baby bottle holders rotatably mounted for rotation above the drain, the bottle holders being annular in configuration with an upstanding cylindrical side wall and internal threads for receiving the upper extent of inverted baby bottles to be washed, the holders having apertures in the lower extents of their walls for the draining of water therefrom; a peripheral tube extending upwardly for rotation and with apertures therein for spraying the insides of bottles; and a drive gear beneath the drain, the drive gear including a central gear for acting through a motion imparting assembly for rotating the manifold and a plurality of upper peripheral gears for rotating the bottle holders, a plurality of lower peripheral gears for rotating the peripheral tubes and with a drive to concurrently rotate the manifold, peripheral tubes and holders, the drive means including a paddle wheel with gear teeth to drive the drive gear.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken vertically through the center of the device of the prior Figure.

FIG. 4 is an exploded cross-sectional view of the drive and coupling mechanisms taken along lines 4—4 of FIG. 3.

The same reference numerals refer to the same parts through the various Figures.

DESCRIPTION OF THE PREFERRED EMBODIMENT

Figure 1:
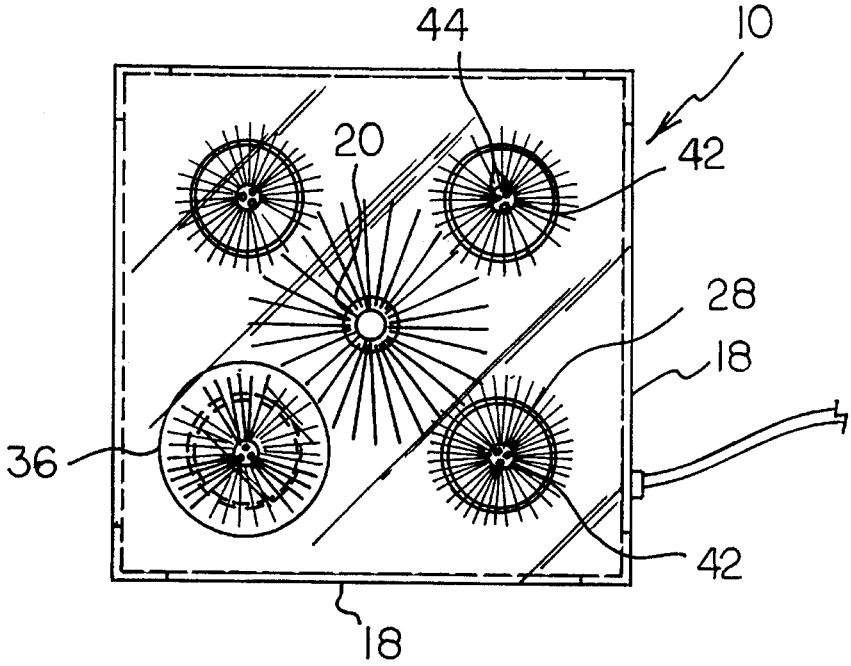
FIG. 1 is a top plan view of the preferred embodiment of the new and improved apparatus for automatically cleaning baby bottles inside and out constructed in accordance with the principles of the present invention.
Figure 2:
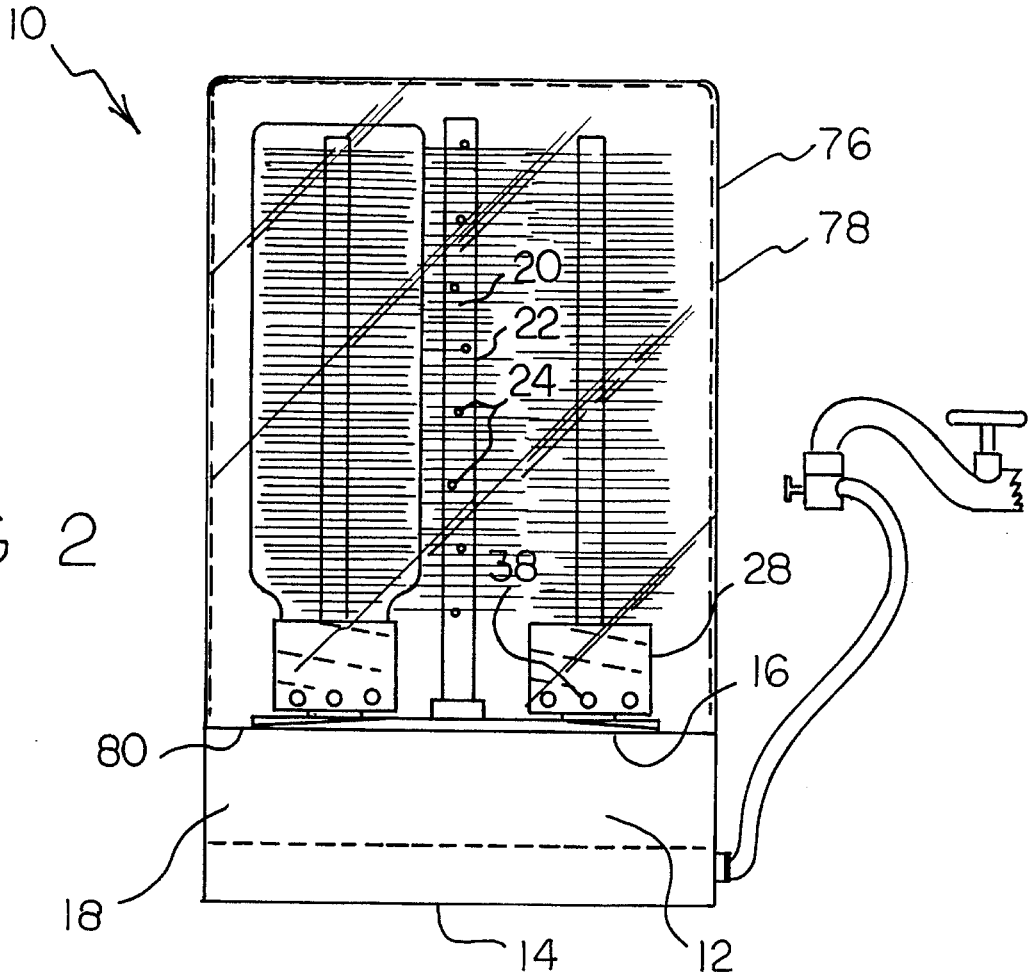
FIG. 2 is a side elevational view of the apparatus shown in FIG. 1.
Figure 5:
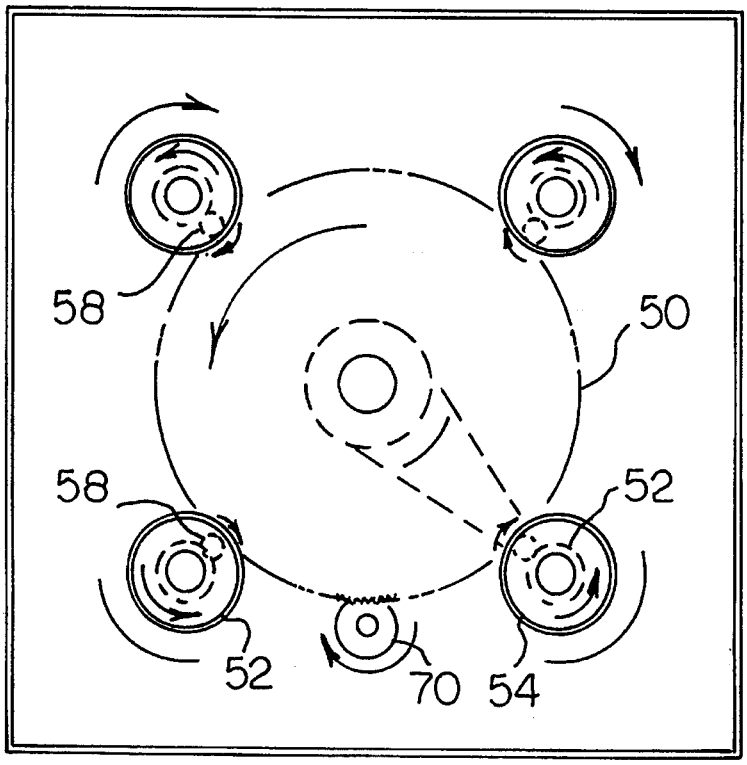
FIG. 5 is a cross-sectional view taken along lines 5—5 of FIG. 3.
Figure 6:
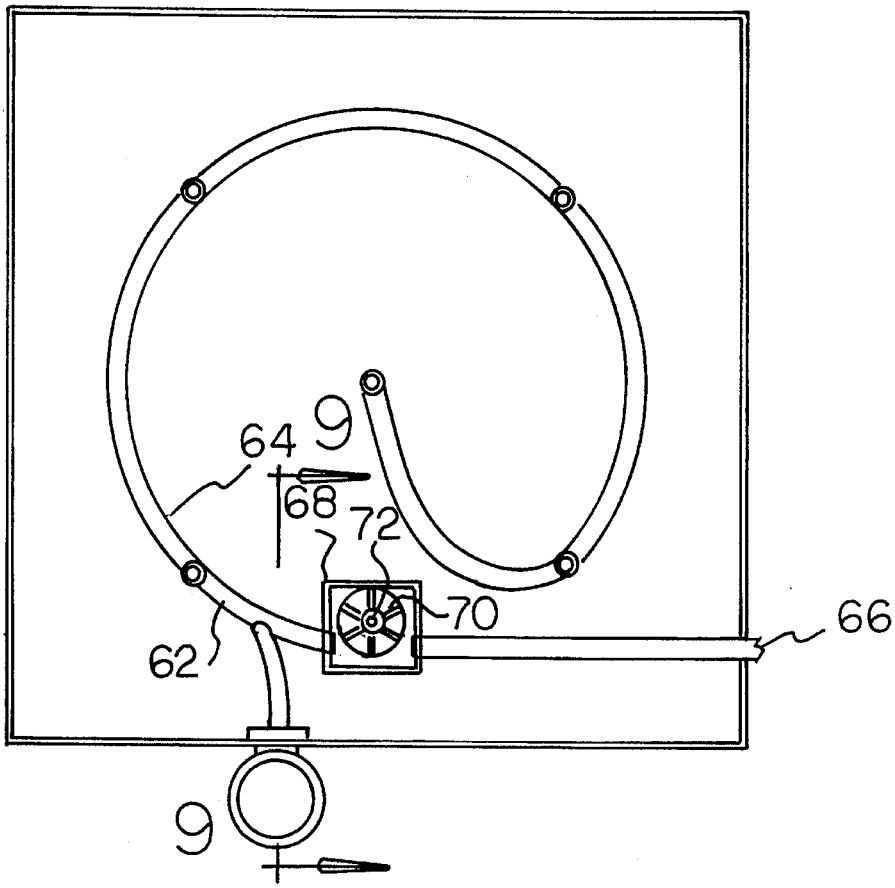
FIG. 6 is a cross-sectional view taken along lines 6—6 of FIG. 3.
Figure 7:
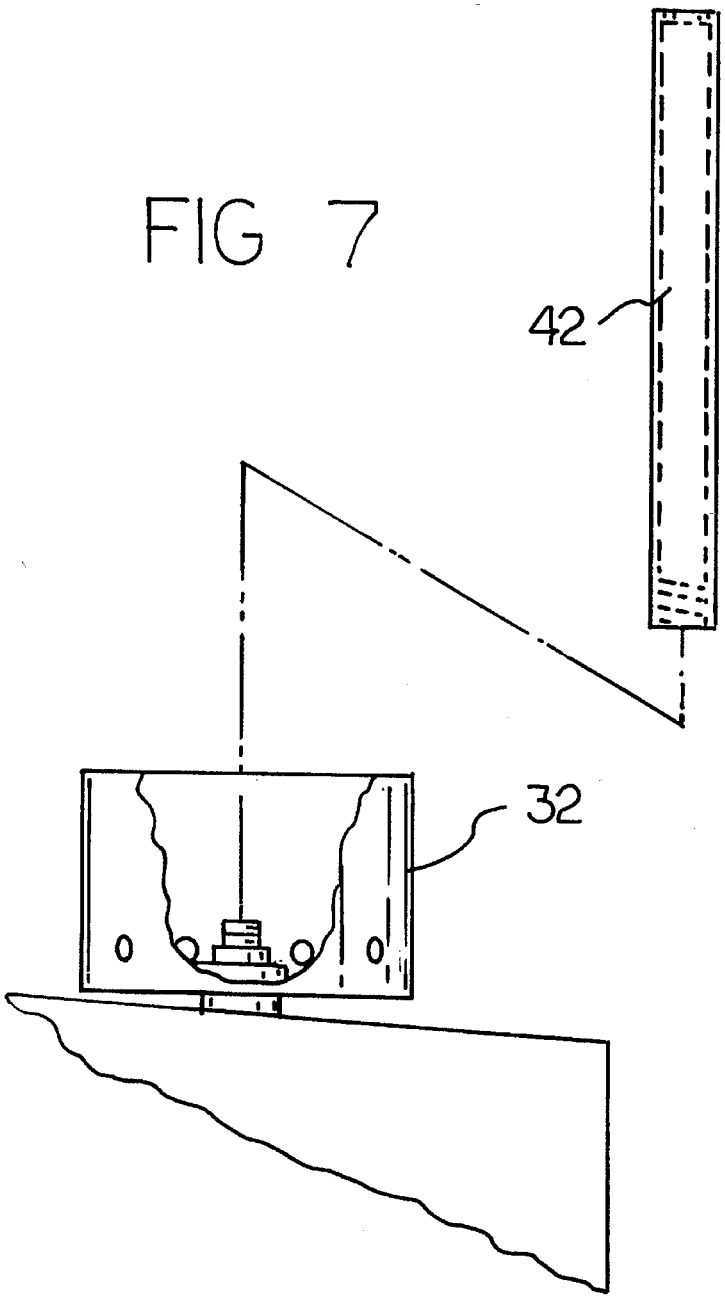
FIG. 7 is an exploded front elevational view of one of the interior bottle cleaning rods of the device of the prior Figure.
Figure 8:
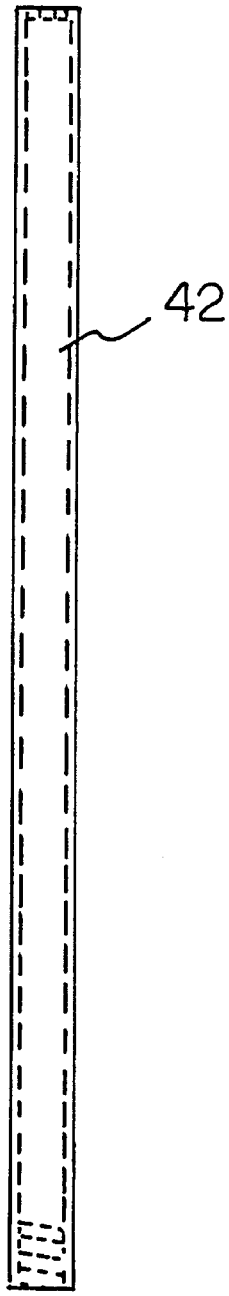
FIG. 8 is a front elevational view of one of the rods of FIG. 7.
Figure 9:
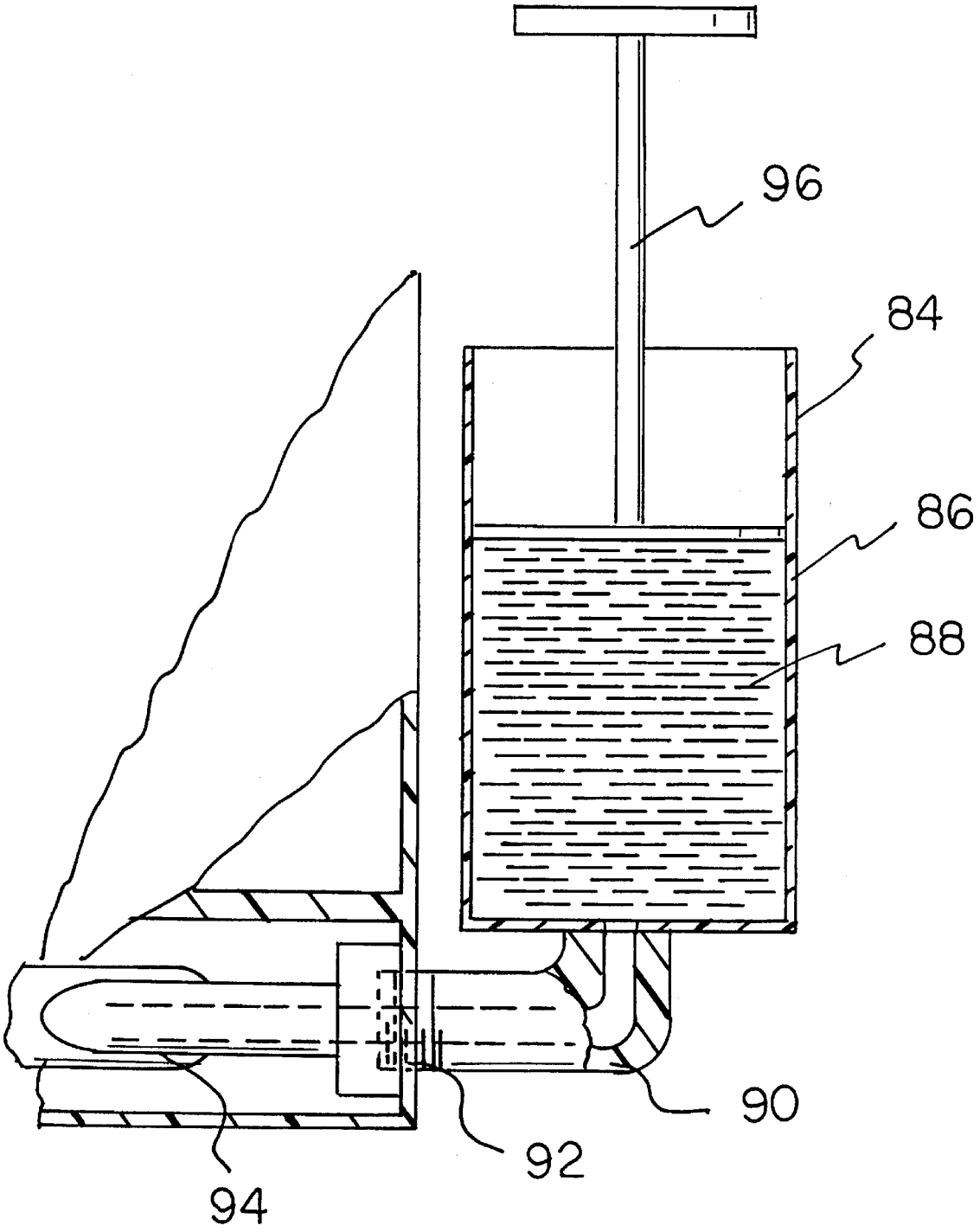
FIG. 9 is a cross-sectional view of the soap dispensing mechanisms.

With reference now to the drawings, and in particular to FIG. 1 thereof, the preferred embodiment of the new and improved apparatus for automatically cleaning baby bottles inside and out embodying the principles and concepts of the present invention and generally designated by the reference numeral 10 will be described.

The present invention, the new and improved apparatus for automatically cleaning baby bottles inside and out, is a system comprised of a plurality of components. In their broadest context, the components include a base, a central manifold, bottle holders, peripheral tubes, a drive gear with associated driven gears, a tube for the introduction of water and a transparent cover. Such components are individually configured and correlated with respect to each other so as to attain the desired objectives.

The central component of the system 10 of the present invention is a base 12. The base is in a generally rectangular configuration. It includes a floor 14, and a drain plate 16 thereabove. The drain plate is offset from parallel with the floor for water run off. Vertically extending parallel side walls 18 couple the floor and the drain plate.

Next provided as a component of the system 10 is a manifold 20. The manifold is a vertically oriented tube 22 with a plurality of apertures 24 through its side wall adapted to spray water from within to exterior thereof for cleaning the exterior of baby bottles thereadjacent. The manifold is centrally located upon the drain plate with a bearing assembly for rotation thereof. It extends upwardly through the drain plate to an elevated orientation with a height essentially to that of baby bottles to be washed.

Next provided are a plurality of baby bottle holders 28. Such holders are rotatably mounted above the drain plate on bearing assemblies 30. This allows for the smooth rotation when a drive force is applied. The bottle holders are annular in configuration. They include upstanding cylindrical side walls 32. Such side walls have internal threads 34 for receiving the upper extent of inverted baby bottles 36. Such baby bottles are those adapted to be washed in the system of the present invention. The holders are formed with apertures 38 in their lower extents of their side walls. This is for allowing the draining of water therefrom during the washing operation.

Extending vertically and parallel with the manifold are a plurality, four in the preferred embodiment, peripheral tubes 42. The peripheral tubes are removable through threads at their lower ends. This allows for their interchangability to allow for incorporation of tubes of different sizes to allow cleaning of bottles of different sizes. The tubes extend upwardly and have open ends for the receipt of water to be sprayed. They have closed ends at their upper extent. Small apertures 44 are formed in the upper end for the spraying of water. The peripheral tubes are mounted at their lower ends on bearing assemblies 46 to effect rotation thereof during operation. Motion is provided to the manifold and the peripheral tubes through a drive gear assembly 48. Such drive gear assembly includes a central drive gear 50 for rotating the manifold. The manifold 20 extends through the center of drive gear 50 via a bearing assembly and is coupled to a pulley that rotates it. Such pulley is attached by a belt to an idler-pulley assembly that rotates it in the opposite direction with the central drive gear 50. The manifold is coupled at its lower end to the center of rotation of the drive gear. The drive gear assembly also functions to rotate driven gears 52 secured to the lower ends of the peripheral tubes. These are the peripheral driven gears. As a result, when the drive gear rotates, it will rotate the manifold as well as the peripheral tubes as required for a complete cleaning of the bottles. The drive gear also rotates driven holder gears 54 for rotating the bottles supported on the bottle holders.

As such, the drive gear functions to concurrently rotate the central manifold, the peripheral tubes, as well as the bottle holders. The various drive and driven gears are coupled through their meshing cooperatively and include idler gears 58 which meshingly couple the drive gear and the gears for the peripheral tubes. Note is taken of the opposite direction of rotation with respect to each other among the manifold, bottle holders, and peripheral tubes wherein such opposite rotations are effected by the use of idlers.

Power is provided to the drive gear through a hydraulic assembly 62. Such assembly includes a tube 64. The tube has an input end 66 adapted to be coupled to a source of water under pressure as for example, the spicket of a sink. The tube also has a plurality of apertures therein along the length within the face. Such apertures are for coupling to the lower extent of each peripheral tube as well as the manifold for the intended cleaning through the spraying of water to the interior of the bottles as well as to the exterior of the bottles simultaneously. The tube also has in its path of travel a power box 68. Such box has therein a paddle wheel 70 having one extent in line with the flow of water through the tube. The axis of rotation and axle 72 of the paddle wheel is offset from the axis of the tube and has a portion extending outwardly thereof for driving the drive gear. As a result, the power of the water being used for the spraying function also provides the power to effect the rotation of the various components.

The last component of the system 10 is a cover 76. The cover is preferably fabricated of a rigid transparent, plastic material. It is formed with a plurality of rectangular side walls 78 each in a rectangular configuration and a rectangular cross-section corresponding to the upper surface of the base. The cover also has an opening 80 at its lower extent. The opening at the lower extent is adapted to fit over the upper edge of the base in a watertight relationship. Lastly, the transparent cover has a top wall whereby during operation and use the water is contained within the base from which it may drain during and after operation.

Located in operative communication with tube 64 is a soap dispenser 84. Such dispenser includes a reservoir 86 for a liquid soap 88. A pipe 90 extends from a hole in the bottom of the reservoir where it is threadably coupled to a supplemental line 94. Supplemental line 94 is in fluid communication with tube 64 for feeding soap from the reservoir to join flowing water for use in cleaning bottles. A plunger has a lower end for urging soap through the lines and an upper end under the control of a user for urging out additional soap.

New parents are always constrained for time. New babies need almost constant attention, which also dramatically increases the laundry duties and also the general fatigue derived from being up at all hours of the day and night to tend to newborns. Parents must wash bottles and pacifiers and keep up with all the other activities in their lives. With all these pressures, they are always looking for a more convenient way to clean baby bottles quickly, easily and more effectively.

The present invention consists of four vertical peripheral tubes which are used to clean the bottles. Water is supplied from a plastic tube which can be attached to the kitchen sink which is directed throughout the base of the unit. The water is distributed through pipes for use throughout the system. A transparent housing covers the bottles which prevents water from spraying over the area.

To use the present invention, the parent places the bottles face down onto the bottle holders, then fastens the tube to the faucet in the kitchen sink. He or she then turns the unit and water on, allowing the water to travel through the tube and into the bottles. Soap is injected into the system to promote the cleaning action. This action causes the peripheral tubes to turn, which scrubs the bottles and forces out the dried milk, thereby fully cleaning the bottles. When the cycle is done, the parent removes the bottles from the tubes and disconnects the device from the faucet. This device can then easily be stored within easy reach of the sink area.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for automatically cleaning baby bottles inside and out comprising, in combination:

a base in a generally rectangular configuration having a floor, a drain thereabove offset from and parallel therewith for water run off and parallel side walls coupling the floor and the drain;

a cylindrical manifold centrally located above the drain extending upwardly through the drain to a location thereabove;

a plurality of baby bottle holders rotatably mounted for rotation above the drain, the bottle holders each being annular in configuration with an upstanding cylindrical side wall and internal threads for receiving the upper extent of inverted baby bottles to be washed, the holders having apertures in the lower extents of their walls for the draining of water therefrom;

peripheral tubes, each tube extending upwardly for rotation and with apertures therein for spraying the insides of bottles;

a drive gear beneath the drain, the drive gear including a central gear for acting through a motion imparting assembly for rotating the manifold and a plurality of upper peripheral gears for rotating the bottle holders, a plurality of lower peripheral gears for rotating the peripheral tubes and with a drive to concurrently rotate the manifold, peripheral tubes and holders, the drive including a paddle wheel with gear teeth to drive the drive gear;

a tube having an input end adapted to be coupled to a source of water under pressure, the tube having a plurality of apertures therein coupled to the lower extent of each peripheral tube and manifold for the spraying of water to interior of the bottles and exterior thereof simultaneously, the tube also including a region coupled with the paddle wheel for powering the paddle wheel for rotation of the drive gear; and a transparent cover having a plurality of side walls in a rectangular configuration with a transparent top wall and an opening at the lower extent, the opening at the lower extent adapted to fit over the base in a watertight relationship.

2. An apparatus for automatically cleaning baby bottles inside and out comprising:

a base in a generally rectangular configuration having a floor, a drain thereabove offset from and parallel therewith for water run off and parallel side walls coupling the floor and the drain;

a cylindrical manifold centrally located above the drain extending upwardly through the drain to a location thereabove;

a plurality of baby bottle holders rotatably mounted for rotation above the drain, the bottle holders each being annular in configuration with an upstanding cylindrical side wall and internal threads for receiving the upper extent of inverted baby bottles to be washed, the holders having apertures in the lower extents of their walls for the draining of water therefrom;

peripheral tubes, each tube extending upwardly for rotation and with apertures therein for spraying the insides of bottles; and a drive gear beneath the drain, the drive gear including a central gear for acting through a motion imparting assembly for rotating the manifold and a plurality of upper peripheral gears for rotating the bottle holders, a plurality of lower peripheral gears for rotating the peripheral tubes and with a drive to concurrently rotate the manifold, peripheral tubes and holders, the drive including a paddle wheel with gear teeth to drive the drive gear.

3. The apparatus as set forth in claim 2 and further including:

a tube having an input end adapted to be coupled to a source of water under pressure, the tube having a plurality of apertures therein coupled to the lower extent of each peripheral tube and manifold for the spraying of water to interior of the bottles and exterior thereof simultaneously, the tube also including a region coupled with the paddle wheel for powering the paddle wheel for rotation of the drive gear.

4. The apparatus as set forth in claim 2 and further including:

a soap dispenser for introducing a liquid soap into the apparatus.

5. The apparatus as set forth in claim 2 wherein the peripheral tubes and manifold are covered with brushes.

6. The apparatus as set forth in claim 2 wherein the peripheral tubes and manifold are covered with bristles.

* * * * *